US006443779B2

(12) United States Patent
Suzuki

(10) Patent No.: US 6,443,779 B2
(45) Date of Patent: Sep. 3, 2002

(54) ELECTRICAL CONNECTION BOX

(75) Inventor: Tatsuo Suzuki, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/842,920

(22) Filed: Apr. 27, 2001

(30) Foreign Application Priority Data

Apr. 27, 2000 (JP) ..... 2000-127372

(51) Int. Cl.[7] ..... H01R 13/502
(52) U.S. Cl. ..... 439/701; 439/557; 439/86.2
(58) Field of Search ..... 439/701, 76.2, 439/553, 557, 362, 364

(56) References Cited

U.S. PATENT DOCUMENTS

| | | | | |
|---|---|---|---|---|
| 4,956,748 A | | 9/1990 | Yamamoto et al. | |
| 5,000,693 A | | 3/1991 | Hatagishi et al. | |
| 5,800,208 A | | 9/1998 | Ishizuka et al. | |
| 6,027,360 A | | 2/2000 | Jenkins | |
| 6,126,458 A | * | 10/2000 | Gregory, II et al. | 439/76.2 |
| 6,132,246 A | * | 10/2000 | Kodama | 439/557 |

FOREIGN PATENT DOCUMENTS

| | | |
|---|---|---|
| EP | 0334342 A | 9/1989 |
| EP | 0920083 A | 6/1999 |
| EP | 0 920 087 A1 | 6/1999 |
| GB | 2 338 355 A | 12/1999 |

* cited by examiner

*Primary Examiner*—Khiem Nguyen
(74) *Attorney, Agent, or Firm*—Oliff & Berridge, PLC

(57) ABSTRACT

An electrical connection box has a substrate carrying electrical components, a molded synthetic resin casing fitted on the substrate at the lower side thereof, and a connector receivable in the casing and mountable at a predetermined position on the substrate. The connector has electrical, terminals engageable with electrical terminals of the substrate. A fastener is inserted in the substrate to draw the connector to its predetermined position. A holder for the connector is molded in one piece with the casing, and is open at its upper side to receive the connector. The connector and the holder have holding elements which are mutually engageable to hold the connector in the holder, prior to the operation of the fastener to draw the connector to its predetermined position, whereby the fastener through the connector holds the casing at its fitted position on the substrate.

10 Claims, 6 Drawing Sheets

ELECTRICAL CONNECTION BOX

BACKGROUND OF THE INVENTION

1. Field of the Invention

The present invention relates to an electrical connection box suitable to be mounted on a vehicle, such as an automobile.

2. Description of the Related Art

FIG. 6 shows one known form of an electrical connection box of a vehicle. Electrical parts 32, such as relays, are mounted on an upper surface of a substrate in a junction block 31. A lower casing or cover 33 for the junction block 31 is fitted on the junction block 31 from below. The lower cover 33 accommodates connectors 34 connected to the end of a wire harness not shown in FIG. 6. The wire harness passes out of the lower cover 33 through an aperture (not shown) in the lower cover. Columnar projections 35 for temporarily locking the connectors 34 to the lower cover 33 project up from the base of the lower cover 33. Approximately cross-shaped temporary locking holes 36 into which the projections 35 can be inserted are formed in the base of lower covers 37 that are fitted on a lower side of the connectors 34.

When assembling the electrical connection box of FIG. 6, initially the lower covers 37 are fitted on the connectors 34. Then the projections 35 are inserted into the temporary locking holes 36 of the covers 37 to temporarily lock the connectors 34 to the base of the lower cover 33. Then, with the lower cover 33 fitted on the junction block 31, bolts. 38 inserted through the junction block 31 into complementary screwthreads of the connectors 34 are tightened. As a result, the connectors 34 are brought up to the junction block 31 and fixed in position on the junction block 31, so that, terminals of the components 32 engage terminals in the connectors 34.

However, in this construction, the gap between the connectors 34 and the lower covers 37 is large. Therefore, vibration causes both the connectors 34 and the lower cover 37 to be loosened and to shake. Consequently, noise is apt to be generated.

Further, because the lower cover 37 is, required in assembling the electrical connection box, a large number of component parts are required. Thus, the manufacturing cost of the electrical connection box is high.

GB-A-2338355 shows an electrical connection box similar to that of FIG. 6, in which a flotation, bracket, which is lockable into position on the lower cover, is provided inside the lower cover. The bracket receives the connectors from below, for initial positioning of the connectors.

SUMMARY OF THE INVENTION

Accordingly, it is an object of the present invention to provide an electrical connection box that has a construction which does not generate noise easily and can be made at low cost.

According to the present invention, there is provided an electrical connection box that includes:

(i) a substrate that carries electrical components and has a plurality of electrical terminals, (ii) a molded synthetic resin casing adapted to be fitted on the substrate at the lower side thereof, (iii) at least one connector that is receivable in the casing and mountable at a predetermined position on the substrate and has a plurality of electrical terminals engageable with said electrical terminals, of the substrate when the connector is brought to its predetermined position, (iv) at least one fastener inserted in the substrate and engageable with the at least one connector and operable to draw the at least one connector to the predetermined position, and (v) at least one holder for the connector that is molded in one piece with the casing and is open at its upper side to receive the connector.

In the electrical connection box, the connector(s) and the holder(s) have respective holding elements which are mutually engageable to hold the connector(s) in the holder(s), prior to the operation of the fastener to draw the connector to its predetermined position, whereby the fastener(s) through the connector(s) holds the casing at its fitted position on the substrate.

Preferably, the holder is constituted by at least two upstanding walls in the casing and the holding elements include mutually abutting projections on mutually opposed surfaces of the connector and the upstanding walls.

Preferably, the holding element of each upstanding wall has a cantilever arm projecting downwardly and integrally connected at its upper end with the side wall. This projection is preferably at the lower free end of the cantilever arm.

In the present invention, the connector is first engaged by the holder by insertion from above. The holder is integral with the casing, so that loosening of the connector from the casing is prevented. No additional part, such as the lower cover 37 of FIG. 6, is required in temporarily fixing the connector to the casing. Thus, the electrical connection box requires a smaller number of component parts than the known electrical connection box, and the manufacturing cost is reduced. The operation of the fastener, e.g. a bolt, draws both the connector and the casing into position, and holds them in the final position, so that loosening of the parts is minimized. Thus, noise is not generated in use.

In the present invention, each holder is preferably integral with the casing. In particular, the holding element of each holder is integral, so that the provision of the holder(s) does not increase the number of component parts. Thus the electrical connection box can be produced at a low cost.

It is easy to assemble the electrical connection box.

In this specification and claims, the directional terms "upper", "lower" etc. are used for convenience and clarity of description, and are not intended to limit the invention. The electrical connection box of the invention may be assembled and used in any appropriate orientation.

BRIEF DESCRIPTION OF THE DRAWINGS

Embodiments of the invention will now be described by way of non-limitative example, with reference to the drawings, in which.

DETAILED DESCRIPTION OF THE PREFERRED EMBODIMENTS

Figure 1:
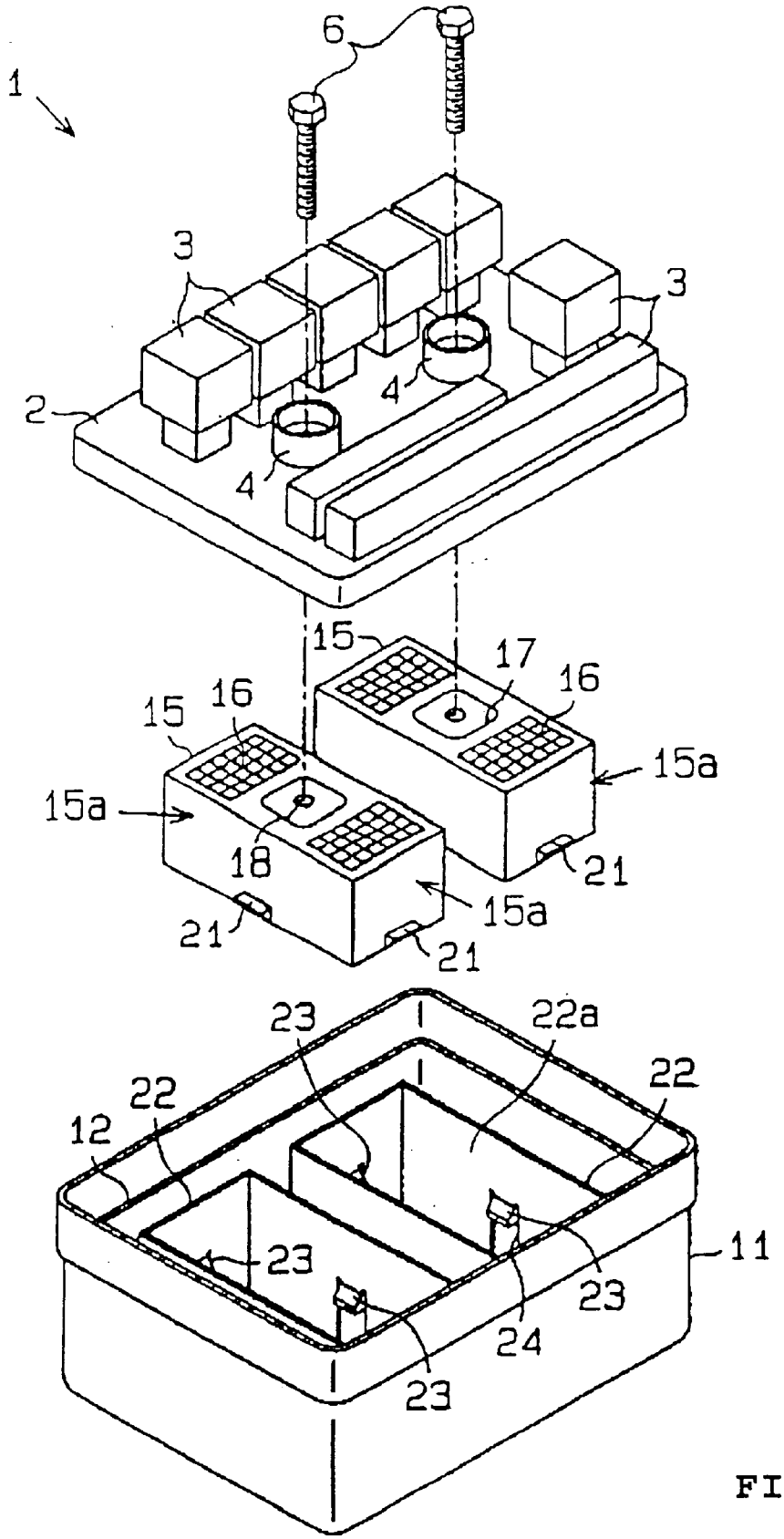
FIG. 1 is an exploded perspective view showing an electrical connection box which is an embodiment of the present invention.
Figure 2:
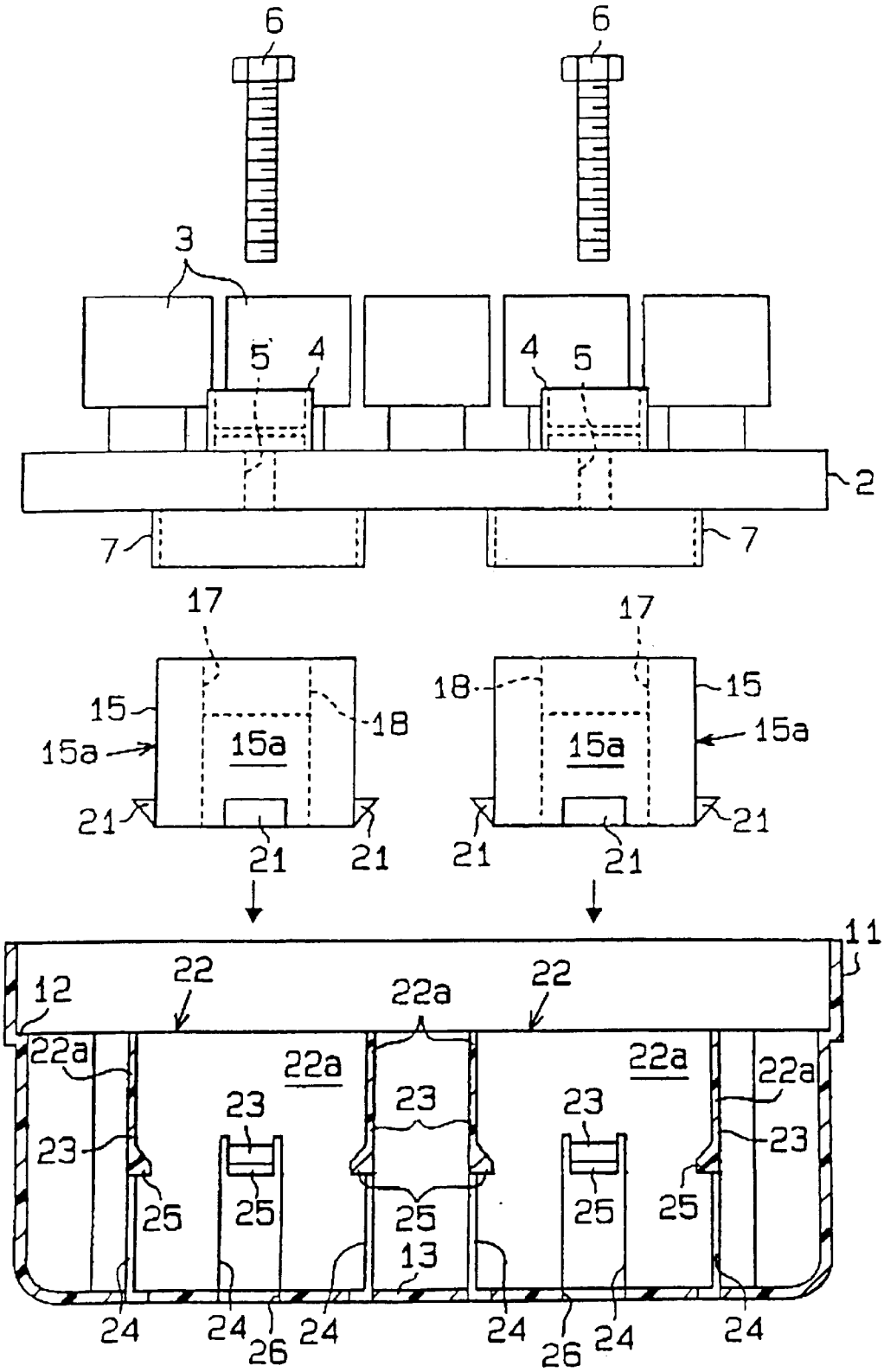
FIGS. 2 to 4 are sectional views showing stages of the procedure for assembling the electrical connection box of FIG. 1.
Figure 3:
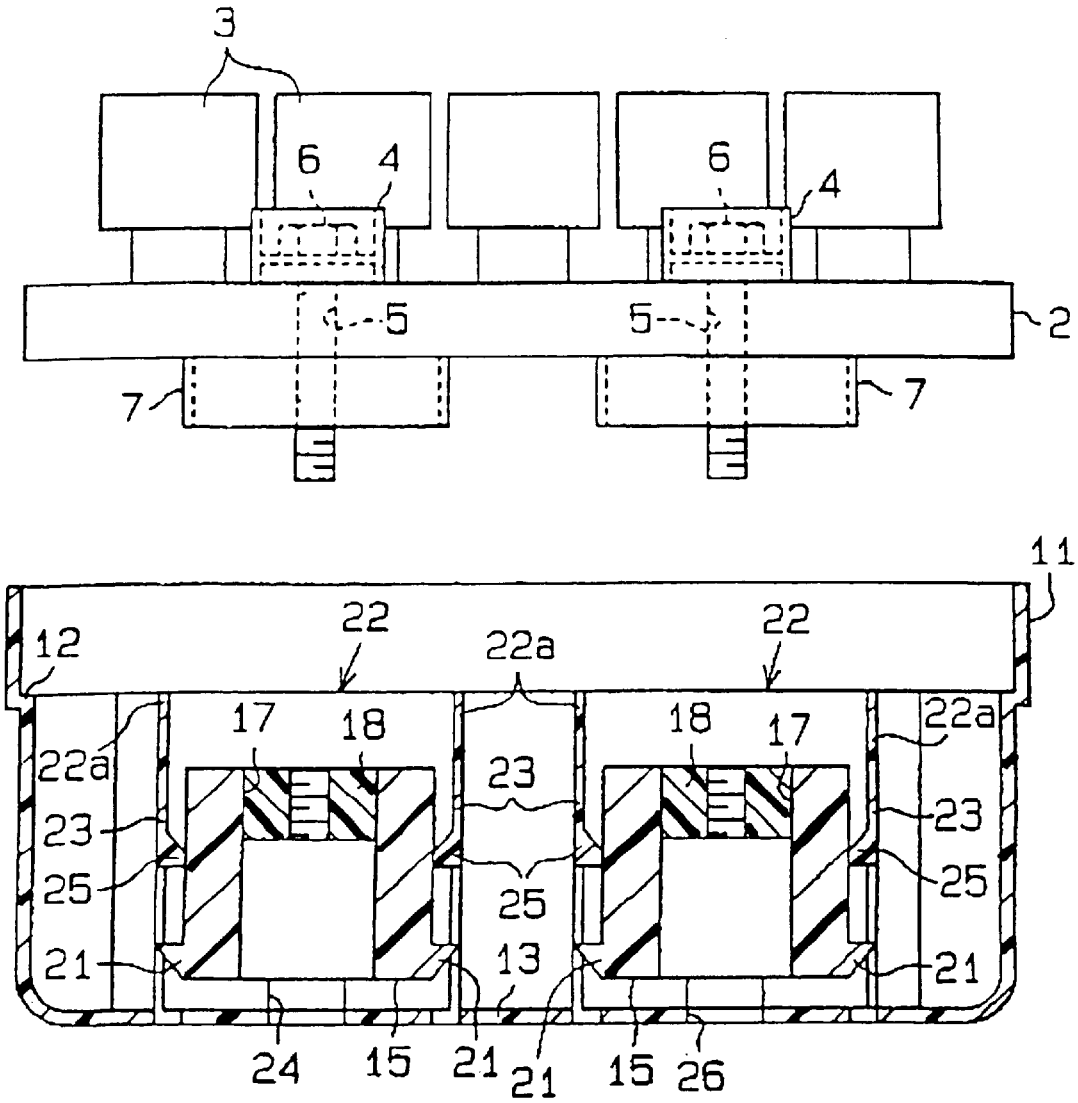
Figure 4:
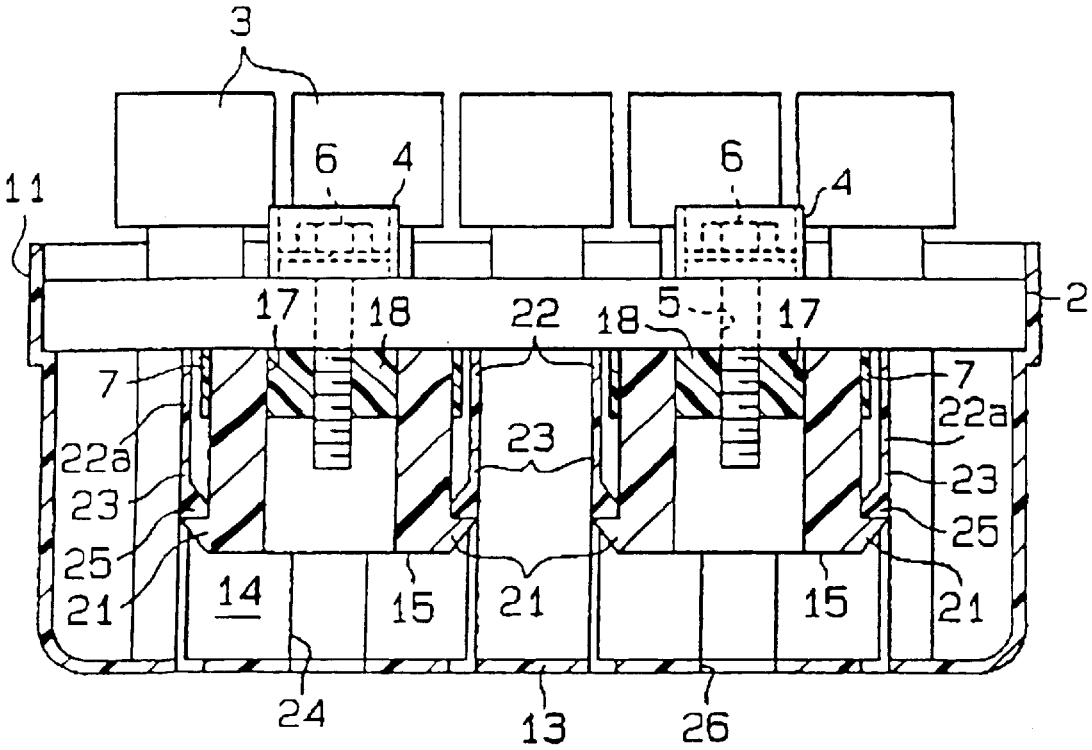

An electrical connection box 1, suitable for a vehicle, shown in FIGS. 1 to 4, is typically installed in an engine room of a vehicle to distribute power to component electrical parts in the vehicle. A junction block 2, made of synthetic resin, accommodates a bus bar laminate not shown in FIGS. 1 to 4. A plurality of electrical parts 3 such as fuses, relays and the like are mounted on an upper surface of the junction block 2. Two spaced apart guide portions 4, cylindrical in this example, project upward from the upper surface of the junction block 2. As shown in FIGS. 2–4, a bolt insertion hole 5 penetrating through the junction block 2 is formed at the center of each guide portion 4. A bolt 6 constituting a fastener can be inserted into each bolt insertion hole 5 from above the junction block 2. Two walls 7, rectangular in this example, project downward from the lower surface of the junction block 2 around the respective bolt insertion holes 5. A plurality of male terminal tabs (not shown) of bus bars of the bus bar laminate project down in the regions surrounded by the walls 7.

As shown in FIGS. 1 to 4, an upwardly open casing in the form of a lower cover 11 is fitted on the junction block 2 from below. The lower cover 11 may be molded of suitable synthetic resin and may, for example, be of rectangular box shape. When fitting the lower cover 11 on the junction block 2, the junction black 2 is seated on a stepped portion 12 formed on the inner surface near the opening of the lower cover 11. As a result, the junction block 2 is supported horizontally by the lower cover 11, parallel with the base 13 of the lower cover 11.

A plurality of molded connectors 15 (two in this embodiment) is accommodated in the space 14 between the lower surface of the junction block 2 and the base 13 of the lower cover 11. Each connector 15 is made of synthetic resin and is of rectangular shape. A plurality of female contacts or terminals 16 is embedded inside the connectors 15 such that the female contacts 16 extend vertically. The male terminal tabs of the bus bars of the junction block 2 can be removably inserted into the open ends of the female contacts 16 at the upper surface of the connector 15. A through-hole 17 extending vertically may be formed at the center of the upper surface of the connector 15. A threaded nut 18 is embedded inside the through-hole 17, and a bolt 6 is screwed into the nut 18. The wire harness (not shown) extends from the lower surface of the connectors 15, with each electrical wire of the wire harness connected to one of the female contacts 16.

The electrical connection box 1 may have an arrangement for fixing the connectors 15 temporarily to the lower cover 11, before the connectors 15 are fixed to the junction block 2.

As shown in FIGS. 1 to 4, each connector 15 has locking projections 21 serving as first holding elements. The locking projections 21 may be formed at a plurality of positions on the side surfaces 15*a* of the connector 15. For example, the locking projections 21 may be formed on each of the four side surfaces 15*a* (in total, four locking projections 21 are formed). Each locking projection 21 is located at the central lowermost position of the side surface 15*a*. In the embodiment, each locking projection 21 has a shape of an inverted triangle in vertical section and is molded integrally (in one piece) with the connector 15.

The lower cover 11 has a pair of open-topped boxes 22 serving as holders for the connectors, molded integrally with the outer walls and base of the cover 11. Each box 22 is formed by four walls 22*a* standing up from the inner surface of the base 13 of the lower cover 11 and is rectangular. The external dimension of the box 22 is a littler larger than that of the connector 15. The height (depth) of the box 22 is also a little larger than that of the connector 15. Thus, when the connector 15 ,is inserted into the box 22, the box 22 surrounds the entire: periphery of the connector 15.

Each box 22 has four flexible locking pieces 23 serving as' second holding elements, formed at a plurality of positions around the box 22 on the respective walls 22*a*, corresponding in position to the four locking projections 21 of the connector 15. In each connector-holding box 22, a vertical slot 24 is formed at the center of each of the four walls 22*a* constituting the box 22. Abase portion (upper end) of the locking piece 23 is connected with the upper edge of the slot 24. The locking piece 23 extends toward the lower end of the box 22. A claw 25 is formed on the inner side of the front portion (lower end) of the locking piece 23. As shown in FIG. 2, the distance between the lower end of the box 22 and the lower end of the claw 25 is about half of the height of the box 22. In the embodiment, the locking piece 23 is molded integrally (in one piece) with the box 22.

In assembling the electrical connection box 1 having the above-described construction, the wire harnesses connected with the connectors 15 are drawn out through holes 26 formed in the base 13 of the lower cover 11. As shown in FIG. 2, each connector 15 is pressed into the box 22 from above (downward from the top opening of the lower cover 11). Then, as shown in FIG. 3, the connector 15 is inserted into the respective box 22 to temporarily seat the connector 15 on the base 13 of the lower cover 11. As the connector 15 is pressed into the box 22, the locking pieces 23 deform outwardly and elastically, by contact with the projections 21. After the projections 21 have passed beneath them, the locking pieces 23 return to their original configurations.

FIG. 3 shows the connectors 15 inserted deeply into the boxes 22. At this time, because the locking projections 21 and the locking pieces 23 are spaced, they are not engaged to each other. If a force is applied upwardly to the connector 15, the connector 15 moves upward a little. As a result, the locking projections 21 engage the claws 25 of the locking pieces 23. In this way the connector 15 is prevented from moving further upward and is held reliably inside the box 22. That is, the connector 15 is prevented from being removed from the connector-holding box 22.

Then, the lower cover 11 is fitted on the junction block 2 from below to support the junction block 2 at the stepped portion 12 of the cover 11. The bolts 6 inserted through the holes 5 of the junction block 2 are engaged in the nuts 18 and tightened. As a result, as shown in FIG. 4, the connectors 15 are drawn upwardly towards the junction block 2, bringing the connectors 15 into the rectangular walls 7, with the two connectors 15 in alignment with each other and fixed tightly to the junction block 2. At this time, the male tabs of the junction block 2 are connected to the female contacts 16.

Thereafter, an upper cover (not shown) may be mounted on the lower cover 11 to cover the junction block 2 from above.

Figure 6:
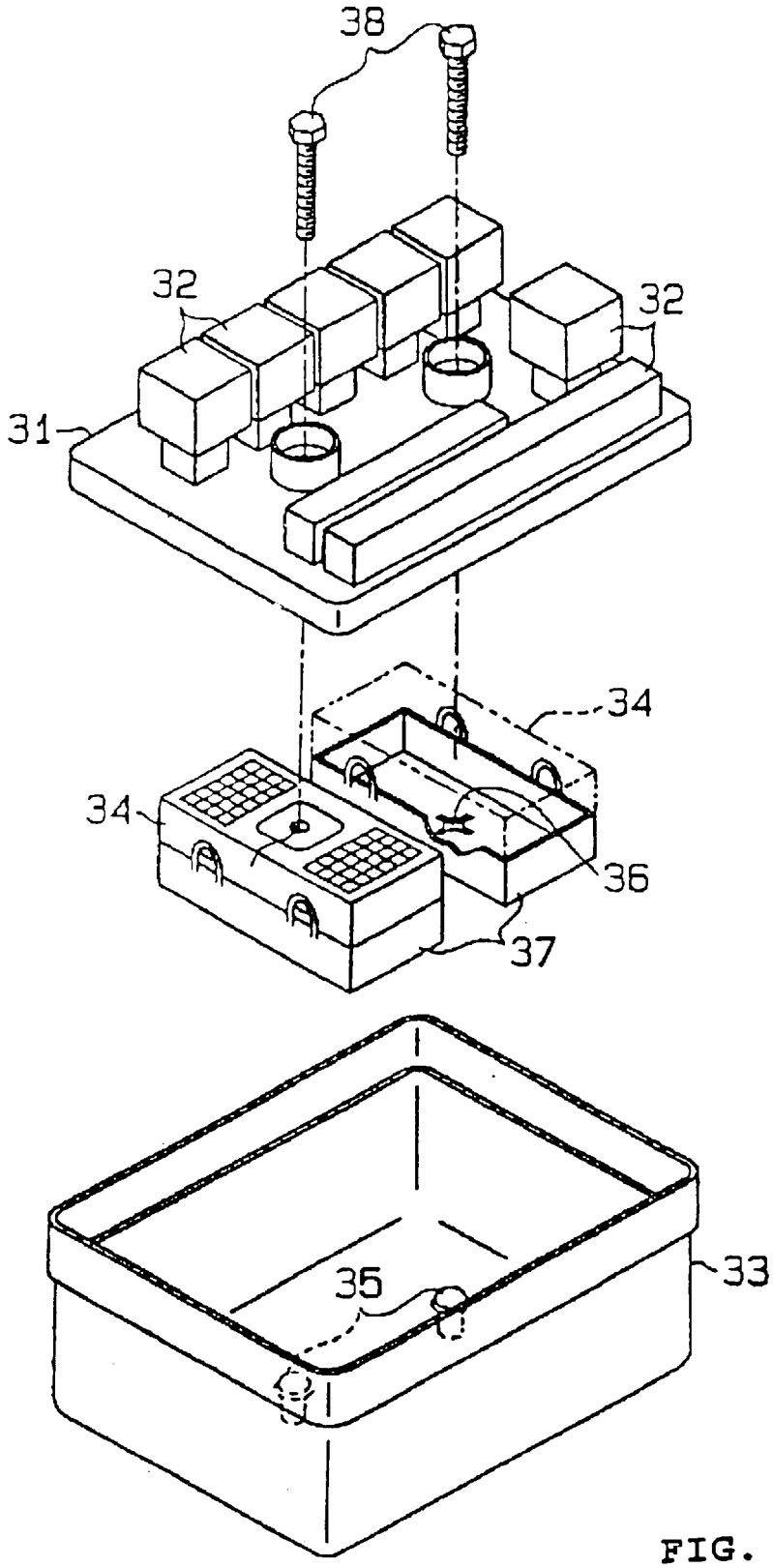
FIG. 6 PRIOR ART
FIG. 6 is an exploded perspective view of a known electrical connection box described above.

This embodiment provides the following effects:

(1) The electrical connection box 1 of the embodiment has integral structure that holds the connectors 15 in the cover 11, including the locking projections 21 and the boxes 22 with the locking pieces 23. Thus, no lower cover fitted on the connector 15 is required when temporarily fixing the connector 15 to the lower cover 11. Accordingly, the electrical connection box of the embodiment has a smaller number of component parts than the known box of FIG. 6, and manufacturing cost is reduced. Because no lower cover on the connector 15 is required, there is no problem of looseness of such a lower, cover and no risk of noise generation.

(2) In the electrical connection box 1, the entire periphery of the connector 15 is surrounded by the holding box 22. In addition, the locking projections. 21 engage the flexible locking pieces 23, preventing movement of the connector 15 out of the box 22. Therefore, the connector 15 is reliably retained in position in the lower cover 11.

(3) The box 22 and the locking piece 23 are integral with the cover 11. Thus, the formation of a plurality of the locking pieces 23 does not increase the number of component parts. The electrical connection box 1 can be produced at a low cost. Because the claw 25 is formed on the inner side of the lower end of the locking piece 23, the locking projection 21 can be reliably locked to the lower end of the locking piece 23. The locking pieces 23 on the box 22 extend downward, so that it is possible to mount the connector 15 in the box 22 smoothly so that assembly of the electrical connection box 1 is easy.

(4) As FIG. 4 indicates, the action of drawing the connectors 15 upwardly into their final positions on the junction block 2 also secures the lower cover 11 in position on the block 2, since the locking elements 21, 23 are brought into engagement. The one-piece construction of the lower cover 11 can be easily molded with sufficient precision to achieve this effect, and the flexibility of the claws 25 gives some tolerance while avoiding the possibility that the cover 11 becomes loose on the block 2.

Figure 5:
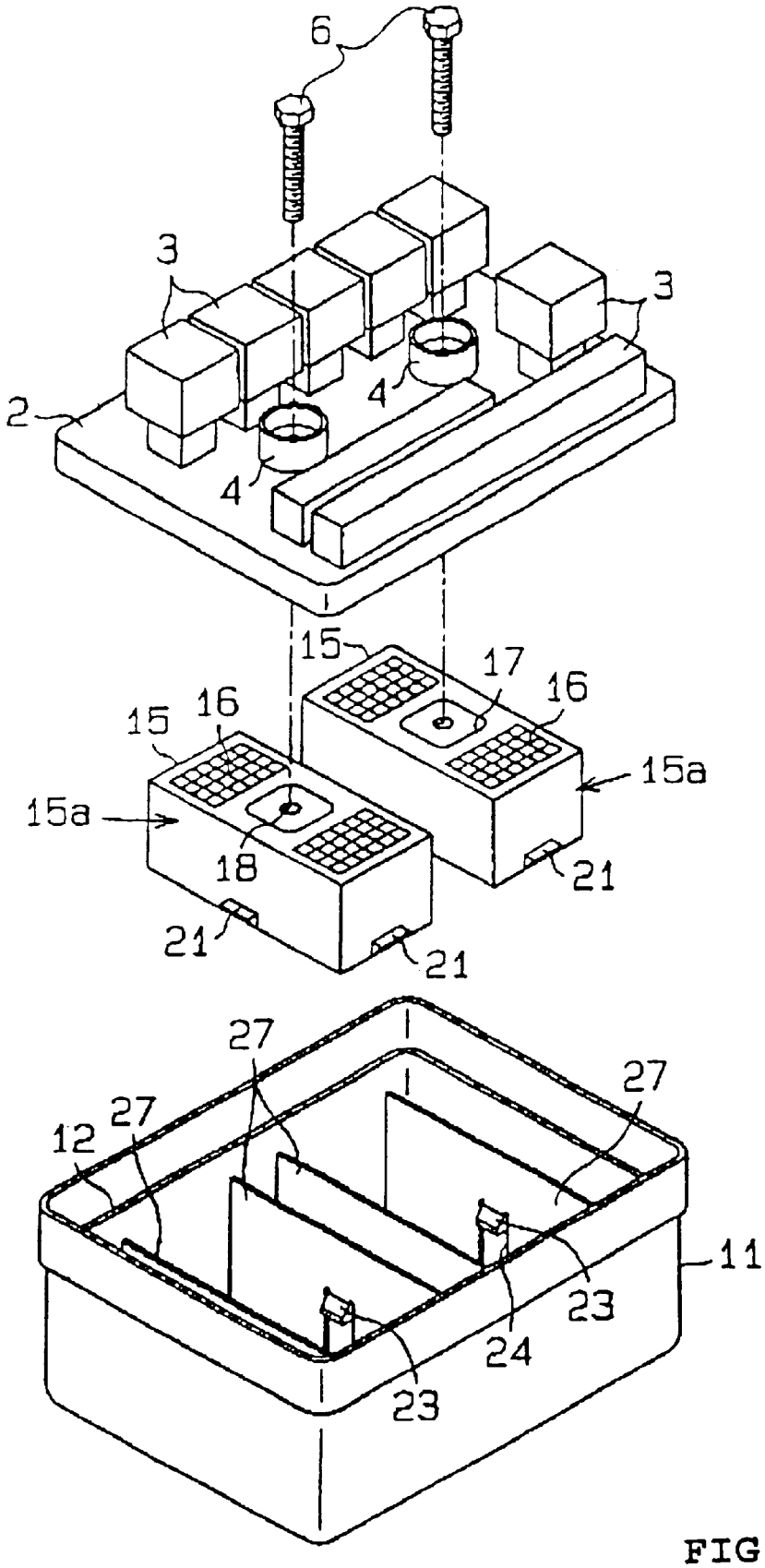
FIG. 5 is a exploded perspective view showing an electrical connection box which is another embodiment of the present invention.

The following modifications of the embodiment within the scope of the invention may be mentioned:

The holder 22 is not necessarily box-shaped, i.e. it need not be continuous such that it surrounds the connector 15 completely in a horizontal direction. For example, the box 22 may be divided into sections at its corners or at other positions. In the electrical connection box 1 of another embodiment of the invention shown in FIG. 5, instead of the continuous box 22, an opposed pair of upstanding cross walls 27 formed integrally with the lower cover 11 constitute a holder to receive each connector 15. The walls 27 carry locking pieces 23. The number of such walls 27 is not limited to two, but may be altered as desired. The configuration and number of the locking projections 21 can be altered as desired. The first locking elements on the connector 15 are not necessarily convex (projection) but may be concave, such, as, groove shaped. The configuration and number of the holding boxes 22 can be altered as desired. The configuration and number of the locking piece 23 can be also altered as desired.

Instead of the holding box 22 projecting from the base 13 of the lower cover 11, it may project from the inner surface of the side walls of the cover 11.

Instead of embedding the nut 18 in the connector 15, the connector 15 may be fixed to the junction block 2 in another manner by the bolt 6, or a fastener other than the bolt 6 may be used.

An electrical part-mounting block (for example, relay block, fuse block and the like) other than the junction block 2 may be used to construct the electrical connection box 1.

What is claimed is:

1. An electrical connection box comprising:

(i) a substrate carrying electrical components and having a plurality of electrical terminals;

(ii) a casing adapted to be fitted on said substrate at the lower side thereof;

(iii) at least one connector receivable in said casing and mountable at a predetermined position on said substrate, and having a plurality of electrical terminals engageable with said electrical terminals of said substrate when said at least one connector is brought to said predetermined position;

(iv) at least one fastener inserted through said substrate and engageable with said at least one connector and operable to draw said at least one connector to said predetermined position; and (v) at least one holder that holds said at least one connector, each at least one holder being integrally molded with said casing, said at least one holder being open at an upper side to receive said at least one connector, wherein (vi) said at least one connector and said at least one holder have respective holding elements which are mutually engageable to hold said at least one connector in said at least one holder, prior to the operation of said at least one fastener to draw said at least one connector to said predetermined position, whereby said at least one fastener through said at least one connector holds said casing at a fitted position on said substrate, (vii) said respective holding elements mutually engage when said casing is fitted on said substrate, and (viii) said at least one holder is constituted by at least two upstanding walls in said casing, and said holding elements comprise mutually abutting projections on mutually opposed surfaces of said at least one connector and said upstanding walls.

2. An electrical connection box according to claim 1, wherein said holding element of each said upstanding wall has a cantilever arm projecting downwardly, an upper end of the cantilever arm being integrally connected with the upstanding wall, said projection being at a lower free end of said cantilever arm.

3. An electrical connection box according to claim 1, wherein said at least one connector comprises two connectors, said at least one fastener comprises two fasteners, and said at least one holder comprises two holders.

4. An electrical connection box according to claim 1, wherein said casing is made of molded synthetic resin.

5. A vehicle having an electrical connection box mounted therein, said electrical connection box comprising:

(i) a substrate carrying electrical components and having a plurality of electrical terminals;

(ii) a casing adapted to be fitted on said substrate at the lower side thereof;

(iii) at least one connector receivable in said casing and mountable at a predetermined position on said substrate, and having a plurality of electrical terminals engageable with said electrical terminals of said substrate when said at least one connector is brought to said predetermined position;

(iv) at least one fastener inserted through said substrate and engageable with said at least one connector and operable to draw said at least one connector to said predetermined position; and (v) at least one holder that holds said at least one connector, each at least one holder being integrally molded with said casing, said at least one holder being open at its upper side to receive said at least one connector, wherein (vi) said at least one connector and said at least one holder have respective holding elements which are mutually engageable to hold said at least one connector in said at least one holder, prior to the operation of said at least one fastener to draw said at least one connector to its said predetermined position, whereby said at least one fastener through said at least one connector holds said casing at a fitted position on said substrate, (vii) said respective holding elements mutually engage when said casing is fitted on said substrate, and (viii) said at least one holder is constituted by at least two upstanding walls in said casing, and said holding elements comprise mutually abutting projections on mutually opposed surfaces of said at least one connector and said upstanding walls.

6. An electrical connection box comprising:

(i) a substrate carrying electrical components and having a plurality of electrical terminals;

(ii) a casing adapted to be fitted on said substrate at the lower side thereof;

(iii) at least one connector receivable in said casing and mountable at a predetermined position on said substrate, and having a plurality of electrical terminals engageable with said electrical terminals of said substrate when said at least one connector is brought to said predetermined position;

(iv) at least one fastener inserted through said substrate and engageable with said at least one connector and operable to draw said at least one connector to said predetermined position; and (v) at least one holder that holds said at least one connector, each at least one holder being integrally molded with said casing, said at least one holder being open at an upper side to receive said at least one connector, wherein (vi) said at least one connector and said at least one holder have respective holding elements which are mutually engageable to hold said at least one connector in said at least one holder, prior to the operation of said at least one fastener to draw said at least one connector to said predetermined position, whereby said at least one fastener through said at least one connector holds said casing at a fitted position on said substrate, (vii) said respective holding elements mutually engage when the at least one connector is at said predetermined position, and (viii) said at least one holder is constituted by at least two upstanding walls in said casing, and said holding elements comprise mutually abutting projections on mutually opposed surfaces of said at least one connector and said upstanding walls.

7. An electrical connection box according to claim 6, wherein said holding element of each said upstanding wall has a cantilever arm projecting downwardly, an upper end of the cantilever arm being integrally connected with the upstanding wall, said projection being at a lower free end of said cantilever arm.

8. An electrical connection box according to claim 6, wherein said at least one connector comprises two connectors, said at least one fastener comprises two fasteners, and said at least one holder comprises two holders.

9. An electrical connection box according to claim 6, wherein said casing is made of molded synthetic resin.

10. A vehicle having an electrical connection box mounted therein, said electrical connection box comprising:

(i) a substrate carrying electrical components and having a plurality of electrical terminals;

(ii) a casing adapted to be fitted on said substrate at the lower side thereof;

(iii) at least one connector receivable in said casing and mountable at a predetermined position on said substrate, and having a plurality of electrical terminals engageable with said electrical terminals of said substrate when said at least one connector is brought to said predetermined position;

(iv) at least one fastener inserted through said substrate and engageable with said at least one connector and operable to draw said at least one connector to said predetermined position; and (v) at least one holder that holds said at least one connector, each at least one holder being integrally molded with said casing, said at least one holder being open at its upper side to receive said at least one connector, wherein (vi) said at least one connector and said at least one holder have respective holding elements which are mutually engageable to hold said at least one connector in said at least one holder, prior to the operation of said at least one fastener to draw said at least one connector to its said predetermined position, whereby said at least one fastener through said at least one connector holds said casing at a fitted position on said substrate, (vii) said respective holding elements mutually engage when the at least one connector is at said predetermined position, and (viii) said at least one holder is constituted by at least two upstanding walls in said casing, and said holding elements comprise mutually abutting projections on mutually opposed surfaces of said at least one connector and said understanding walls.

* * * * *